United States Patent [19]

Lanius

[11] Patent Number: 4,867,727

[45] Date of Patent: Sep. 19, 1989

[54] TOY INCLUDING CENTRIFUGAL SWITCH

[75] Inventor: Charles A. Lanius, Prairie Du Sac, Wis.

[73] Assignee: Flambeau Corporation, Baraboo, Wis.

[21] Appl. No.: 269,588

[22] Filed: Nov. 10, 1988

[51] Int. Cl.[4] ..... A63H 1/24; A63H 1/30

[52] U.S. Cl. ..... 446/242; 446/250; 362/802

[58] Field of Search ..... 446/242, 250, 251, 47, 446/485, 484; 362/802; 200/80 R

[56] References Cited

U.S. PATENT DOCUMENTS

| | | | |
|---|---|---|---|
| 2,201,588 | 5/1940 | Kuhns | 362/802 X |
| 2,611,995 | 9/1952 | Krapp | 446/242 |
| 2,739,419 | 3/1956 | Cleveland | 446/242 |
| 2,795,898 | 6/1957 | French | 446/242 |
| 3,162,979 | 12/1964 | Garoogian | 446/242 |
| 3,191,344 | 6/1965 | Yagjian | 446/242 |
| 3,531,892 | 10/1970 | Pearce | 446/242 |
| 3,924,114 | 12/1975 | Sanchez | 446/242 |
| 4,044,499 | 8/1977 | Toler | 446/242 |
| 4,327,518 | 5/1982 | Knauff | 446/242 |
| 4,568,303 | 2/1986 | Brown | 446/242 |

FOREIGN PATENT DOCUMENTS

| | | | |
|---|---|---|---|
| 703781 | 2/1954 | United Kingdom | 446/242 |

*Primary Examiner*—Mickey Yu

*Attorney, Agent, or Firm*—Michael, Best & Friedrich

[57] ABSTRACT

The invention provides a rotatable device including a body adapted to be supported for rotation about an axis of rotation. A resilient electrically conductive member is supported by the body for rotation with the body, and has first and second blades, the second blade being generally parallel and spaced radially inwardly of the first blade with respect to the axis of rotation of body. The first and second blades of the resilient electrically conductive member define a battery receiving area therebetween adapted to house a button type battery. A electrically operable device is mounted on the second blade of the resilient electrically conductive member and is centrifugally activated when the body is rotated about the axis.

12 Claims, 1 Drawing Sheet

TOY INCLUDING CENTRIFUGAL SWITCH

FIELD OF THE INVENTION

The invention relates to illuminated rotating devices such as yo-yos, tops and spinning toys, and in particular to centrifugal switch configurations for such devices.

BACKGROUND OF THE INVENTION

Some prior art yo-yos, tops and other spinning toys have included illuminating means, whereby the illuminating means is activated by a centrifugal switch. See, for example, U.S. Pat. No. 2,795,898, issued June 18, 1957; U.S. Pat. No. 3,162,979, issued Dec. 29, 1964; U.S. Pat. No. 3,531,892, issued Oct. 6, 1970; U.S. Pat. No. 3,924,114, issued Dec. 2, 1975; and U.S. Pat. No. 4,327,518, issued May 4 1982.

However, the illuminating devices and centrifugal switches used in these products have had relatively complicated constructions, have required the use of a relatively large number of component parts and have been expensive to manufacture.

It is also known to use a centrifugal switch in a rotating device for purposes other than illumination. For example, U.S. Pat. No. 4,568,303, issued Feb. 3, 1986, discloses a rotating device including a centrifugal switch for energizing a music synthesizer. Further, it is known to use a bulb as weight in a centrifugal switch. See, for example, U.S. Pat. No. 3,191,344.

SUMMARY OF THE INVENTION

The invention provides a rotatable device including a body adapted to be supported for rotation about an axis. A resilient electrically conductive member is supported by the body for rotation with the body. The resilient electrically conductive member has first and second blades, the second blade being generally parallel and spaced radially inwardly of the first blade with respect to the axis of rotation of the body. The first and second blades of the resilient electrically conductive member define a battery receiving area therebetween. The battery receiving area is adapted to house a button type battery having a first and second terminal such that the second blade of the resilient electrically conductive member is resiliently movable toward the first blade of the resilient electrically conductive member when the battery is in place. An electrically operable device, such as a miniature bulb, a LED liquid crystal display driver, an IC, a buzzer, a chime, or a similar device is also included having first and second electrical contacts, the electrically operable device being connected to the battery by the first and second electrical contacts. The electrically operable device is mounted on the second blade of the resilient electrically conductive member, with the first contact of the electrically operable device electrically connected to the second blade of the resilient electrically conductive member. A first electrical path is provided between one of the electrical contacts of the electrically operable device and one terminal of the battery when the battery is in place in the battery receiving area. A second electrical path is provided between the other of the electrical contacts of the electrically operable device and the other terminal of the battery when the body is rotated about the axis and when centrifugal force moves the second blade, the resilient electrically conductive member and the electrically operable device toward the first blade of the resilient electrically conductive member. This causes contact between the first terminal of the battery and the first blade of the electrically conductive member, and contact between the second terminal of the battery and the second contact of the electrically operable device, simultaneously.

In one embodiment of the invention, the electrically operable device is of the type having wire contacts projecting therefrom.

In one embodiment of the invention, the battery can be a pair of button type batteries placed in electrical series.

In one embodiment of the invention, the resilient electrically conductive member is generally U-shaped.

In one embodiment of the invention, the rotatable body is a yo-yo.

In one embodiment of the invention a non-conductive cap is provided on the end of the second blade of the resilient electrically conductive member to hold the one contact of the electrically operable device in intimate relation and in electrical contact with the second blade of the resilient electrically conductive member. The other contact of the electrically operable device is bent over the non-conductive cap to be positioned in normally spaced apart relation from the second terminal of the battery. The electrically operable device is thereby mounted on the resilient electrically conductive member by the two wire contacts.

These and other features and advantages of the invention will become apparent to those skilled in the art upon review of the following detailed description of the preferred embodiment of the invention, which is given by way of example only, reference being made to the attached drawings.

DETAILED DESCRIPTION OF THE PREFERRED EMBODIMENT OF THE INVENTION

Figure 1:
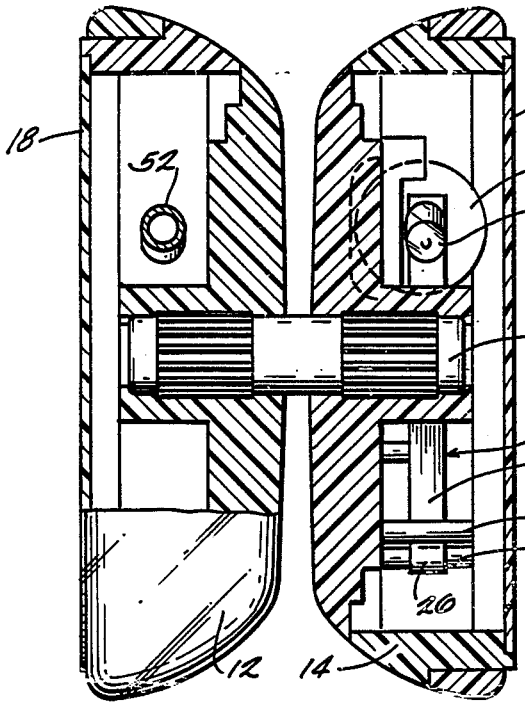
FIG. 1 shows a side view of a yo-yo embodying the invention and broken away to show internal structure.

FIG. 1 illustrates a yo-yo embodying the invention and having a body 10 including two main translucent portions 12 and 14 mounted for rotation about an axis defined by axle 16. In the preferred embodiment, a removable covering piece 18 is provided to facilitate battery installation and replacement.

Figure 2:
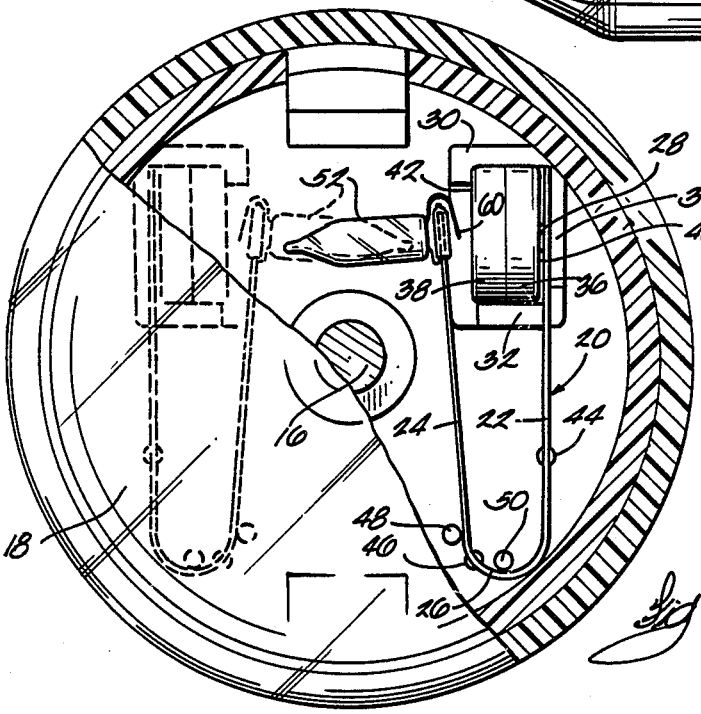
FIG. 2 is a front view of the yo-yo shown in FIG. 1 with a portion of the covering piece broken away.

Referring now to FIG. 2, a front view of the preferred embodiment of the invention, with the covering piece 18 removed can be seen. A resilient, electrically conductive member 20 is bent into a generally U-shaped configuration having a first blade portion 22, a second blade portion 24, and a bite portion 26. A protrusion 28 on first blade 22 defines an electrical contact. The resilient electrically conductive member could be manufactured either from conductive plastic or metal.

Walls 30, 32 and 34 are integrally molded parts or components of the body 10 and define a receptacle for housing "button" type batteries, such as calculator, watch or hearing aid batteries, 36 and 38, in electrical series. The walls 30, 32 and 34 are arranged to allow batteries to be easily installed and replaced when covering piece 18 (see FIG. 1) is removed, and are arranged to hold the protrusion 28 of the blade 22 in electrical contact with one terminal 40 of the series pair of batteries 36 and 38, when the batteries are in place, as shown. The walls 30 and 32 are also arranged to allow the blade 24 to move from a position away from the batteries to a position where electrical contact is made with partially exposed battery terminal 42.

Pins 44 and 46 are integrally molded parts or components of the body 10 and cooperate with walls 32 and 34 to support and locate the resilient electrically conductive member 20 with respect to the body in the direction of the axis of rotation of the yo-yo. Pins 48 and 50 are integrally molded parts or components of the body 10 and also cooperate with the walls 32 and 34 to resiliently hold the resilient electrically conductive member 20 in position in a plane transverse of the axis of rotation.

An electrically operable device 52 having malleable single wire electrical contacts 54 and 56, is mounted to blade 24. The electrically operable device 52, although shown as a miniature bulb in the drawings, could be an LED, a liquid crystal display driver, an IC, a sound emitting device such as a piezo buzzer, a chime, an IC that generates phonetic sounds, or other similar devices. The electrical contact 54 of the bulb 52 is held in intimate relation to blade 24 by an electrically insulating cap 58, to cause electrical connection between the contact 54 and the blade 24, thereby resulting in electrical connection between the contact 54 and the battery terminal 40. The bulb contact 56 is bent around insulating cap 58 as shown, facing battery terminal 42. When the body 10 is caused to rotate about the axle 16, centrifugal force acts on the bulb 52 to cause the blade 24 of the resilient electrically conductive member 20 to move radially outwardly with respect to the axis of rotation of the yo-yo and toward the battery 38 to the point where a portion 60 of contact 56 which is bent over insulating cap 58 makes electrical contact with battery terminal 42, thereby causing the bulb 52 to illuminate.

Figure 3:
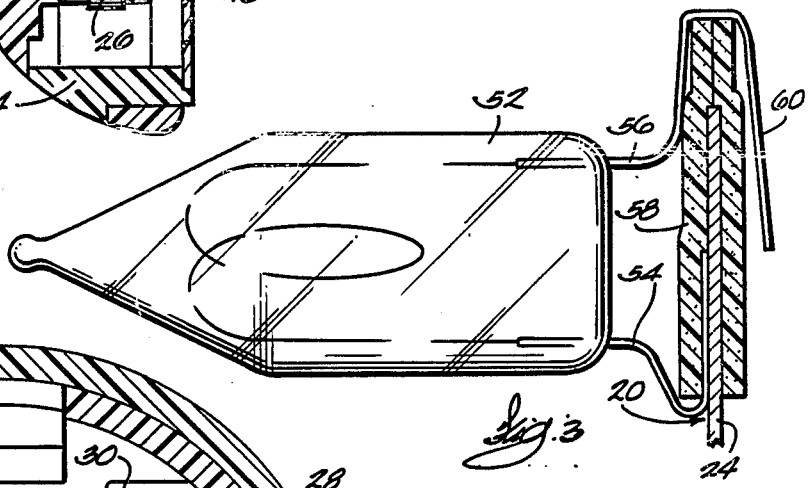
FIG. 3 is a greatly enlarged view of the illuminating means mounting configuration of the yo-yo illustrated in FIGS. 1–2.

Reffering now to FIG. 3, the configuration used to hold the bulb 52 to the blade 24 of the resilient electrically conductive member 24 can be seen in detail. The cap 58 is formed of heat shrink tubing which shrinks when hot to firmly hold the contact 54 to blade 24. Contact 56 is bent around cap 58 as shown so that the portion 60 of contact 56 is bent at about a 5° angle from the blade 24.

While a preferred embodiment of the invention has been set forth, various obvious modifications of the invention will be apparent to those of ordinary skill in the art. For example, while the body 10 has been shown having the shape of a yo-yo, other shapes could be used either with or without an axle, for example, a "frisbee" or spinning top could embody the invention. The batteries 36 and 38 could be replaced by a single battery of appropriate voltage. This battery could be welded or clipped directly to blade 22 or blade 24 of the resilient electrically conductive member 20.

Thus, the scope of the invention should be limited only by the spirit and scope of the appended claims.

I claim:

1. A rotatable device comprising:

a body adapted to be supported for rotation about an axis of rotation;

a resilient electrically conductive member supported by the body, for rotation with the body, said resilient electrically conductive member having first and second blades, the second blade being generally parallel and spaced radially inwardly of the first blade with respect to the axis of rotation of said body, the first and second blades of said resilient electrically conductive member defining a battery receiving area therebetween, the battery receiving area being adapted to house a button type battery having a first terminal and a second terminal such that the first terminal of the button type battery is in electrical contact with the first blade of said resilient electrically conductive member, and such that the second blade of said resilient conductive member is spaced apart from the second terminal of the button type battery and resiliently movable toward the second terminal of the button type battery;

an electrically operable device having first and second electrical contacts, said electrically operable device being operable when electrically connected to the button type battery by the first and second electrical contacts, said electrically operable device being mounted to the second blade of said resilient electrically conductive member, the first electrical contact of the electrically operable device being electrically connected to the second blade of said resilient electrically conductive member, and the second electrical contact of the electrically operable device being normally positioned in spaced apart relation from the second terminal of the button type battery and movable with said second blade to engage the second terminal of the button type battery when the body is rotated about the axis thereby causing centrifugal force to move said second blade and said electrically operable device so that the second electrical contact moves into engagement with the second terminal of the button type battery when the button type battery is in place.

2. A rotatable device in accordance with claim 1 and further including a pair of button type batteries placed in electrical series in the battery receiving area.

3. A rotatable device in accordance with claim 1 wherein said resilient electrically conductive member is generally U-shaped.

4. A rotatable device in accordance with claim 3 wherein said resilient electrically conductive member is manufactured of conductive plastic.

5. A rotatable device in accordance with claim 1 wherein said electrically operable device is of the type having malleable wire contacts projecting therefrom.

6. A rotatable device in accordance with claim 5 further including a non-conductive cap on the end of the second blade of said resilient electrically conductive member to hold the first electrical contact of the electrically operable device in intimate relation and in electrical contact with the second blade of said resilient electrically conductive member.

7. A rotatable device in accordance with claim 6 wherein the other contact of the electrically operable device is bent over the non-conductive cap to be positioned in normally spaced apart relation from the second terminal of the battery, said electrically operable device thereby being mounted on said resilient electrically conductive member by the two malleable wire contacts.

8. A rotatable device in accordance with claim 1 wherein said electrically operable device is an illuminating device.

9. A rotatable device in accordance with claim 8 wherein said electrically operable device is a miniature light bulb.

10. A yo-yo comprising:

a body;

a resilient electrically conductive member supported by said body, said resilient electrically conductive member having first and second blades joined by a bite portion to generally form a U-shape, the second blade being generally parallel and spaced radially inwardly of the first blade with respect to the axis of rotation of said body, the first and second blades of said resilient electrically conductive member and said body defining a battery receiving area between the first and second blade, the battery receiving area being adapted to house a series pair of button type batteries, the series pair of button type batteries having a first terminal and a second terminal such that the first terminal of the battery is in electrical contact with the first blade of the resilient electrically conductive member and such that the second blade of said resilient electrically conductive member is spaced apart from the second terminal of the series pair of button type batteries and resiliently movable toward the second terminal of the series pair of button type batteries, when the series pair of button type batteries is in place;

a miniature bulb of the type having malleable wire contacts projecting therefrom, one of the malleable wire contacts of the bulb being clamped to the second blade of the resilient electrically conductive member by a non-conductive piece of heat shrink tubing, the other of the malleable wire contacts of the bulb being bent around the non-conductive piece of heat shrink tubing and being positioned in normally spaced apart relation from the second terminal of the battery, and being movable with said second blade to engage the second terminal of the series pair of button type batteries when the body is rotated thereby causing centrifugal force to move said second blade and said miniature bulb so that the contact bent around the non-conductive piece of heat shrink tubing moves into engagement with the second terminal of the series pair of button type batteries, said miniature bulb being attached to the second blade of the resilient electrically conductive member only by the malleable wire contacts.

11. A rotatable device comprising:

a body adapted to be supported for rotation about an axis of rotation;

a button type battery having a first terminal and a second terminal;

a resilient electrically conductive member supported by the body, for rotation with the body, said resilient electrically conductive member having first and second blades, the second blade being generally parallel and spaced radially inwardly of the first blade with respect to the axis of rotation of said body, said button type battery being housed between the first and second blades of said resilient electrically conductive member such that the first terminal of the button type battery is in electrical contact with the first blade of said resilient electrically conductive member, and such that the second blade of said resilient conductive member is spaced apart from the second terminal of the button type battery and is resiliently moveable toward the second terminal of the button type battery;

an electrically operable device having first and second electrical contacts, said electrically operable device being operable when electrically connected to the button type battery by the first and second electrical contacts, said electrically operable device being mounted on the second blade of the resilient electrically conductive member, the first electrical contact of the electrically operable device being electrically connected to the second blade of the resilient electrically conductive member, and the second electrical contact of the electrically operable device being normally positioned in spaced apart relation from the second terminal of the button type battery and movable with said second blade to engage the second terminal of the button type battery when the body is rotated about the axis thereby causing centrifugal force to move said second blade and said electrically operable device so that the second contact of the electrically operable device moves into engagement with the second terminal of the button type battery.

12. A rotatable device comprising:

a body adapted to be supported for rotation about an axis of rotation;

a resilient electrically conductive member supported by the body, for rotation with the body, said resilient electrically conductive member having first and second blades, the second blade being generally parallel and spaced radially inwardly of the first blade with respect to the axis of rotation of said body, the first and second blades of said resilient electrically conductive member defining a battery receiving area therebetween, the battery receiving area being adapted to house a button type battery having a first and second terminal; the second blade of the resilient electrically conductive member being resiliently movable relative to the first blade when the battery is in place;

an electrically operable device having first and second electrical contacts, said electrically operable device being operable when electrically connected to the battery by the first and second electrical contacts, said electrically operable device being mounted on the second blade of said resilient electrically conductive member, the first electrical contact of the electrically operable device being electrically connected to the second blade of said resilient electrically conductive member; and a continuous electrical path provided between one of the electrical contacts of the electrically operable device and one terminal of the button type battery, when the battery is in place in the battery receiving area, and a selectively engageable electrical path provided between the other of the electrical contacts of the electrically operable device and the other terminal of the button type battery, the selectively engageable electrical path being selected when the body is rotated about the axis thereby causing centrifugal force to move the second blade of the resilient electrically conductive member and the electrically operable device relative to the first blade of the resilient electrically conductive member to cause contact between the first terminal of the button type battery and the first blade of the electrically conductive member to complete a circuit including the first terminal of the battery, said first blade, said first contact of said electrically operable device, said second contact of said electrically operable device, and said second terminal of said battery.

* * * * *